US008752739B2

(12) United States Patent
Bergkvist et al.

(10) Patent No.: US 8,752,739 B2
(45) Date of Patent: Jun. 17, 2014

(54) BABY CARRIER

(75) Inventors: Håkan Bergkvist, Bromma (SE); Filip Sauer, Stockholm (SE)

(73) Assignee: Babybjorn AB, Solna (SE)

( * ) Notice: Subject to any disclaimer, the term of this patent is extended or adjusted under 35 U.S.C. 154(b) by 93 days.

(21) Appl. No.: 13/259,656

(22) PCT Filed: Apr. 21, 2010

(86) PCT No.: PCT/SE2010/050433

§ 371 (c)(1),
(2), (4) Date: Nov. 8, 2011

(87) PCT Pub. No.: WO2010/123447

PCT Pub. Date: Oct. 28, 2010

(65) Prior Publication Data

US 2012/0043359 A1 Feb. 23, 2012

(30) Foreign Application Priority Data

Apr. 24, 2009 (SE) ..... 0900554

(51) Int. Cl.
*A47D 13/02* (2006.01)

(52) U.S. Cl.
CPC ..... *A47D 13/025* (2013.01)
USPC ..... 224/160; 224/158

(58) Field of Classification Search
CPC ..... A47D 13/02; A47D 13/025
USPC ..... 224/158–161; D3/213–214
See application file for complete search history.

(56) References Cited

U.S. PATENT DOCUMENTS

| | | | | | |
|---|---|---|---|---|---|
| 4,434,920 | A * | 3/1984 | Moore | 224/160 |
| 4,469,259 | A * | 9/1984 | Krich et al. | 224/160 |
| 4,492,326 | A * | 1/1985 | Storm | 224/160 |
| 5,205,450 | A | 4/1993 | Derosier | |
| 5,361,952 | A * | 11/1994 | Gold | 224/159 |
| D357,800 | S * | 5/1995 | Roan et al. | D3/214 |
| 6,415,969 | B1 * | 7/2002 | Higuchi | 224/160 |
| 6,443,339 | B1 * | 9/2002 | Higuchi | 224/160 |
| D507,102 | S * | 7/2005 | Bergkvist et al. | D3/214 |
| 7,766,199 | B1 * | 8/2010 | Caperon | 224/160 |
| 7,886,946 | B2 * | 2/2011 | Gray | 224/160 |
| 8,172,116 | B1 * | 5/2012 | Lehan et al. | 224/160 |
| 8,272,546 | B2 * | 9/2012 | Leistensnider | 224/158 |

(Continued)

FOREIGN PATENT DOCUMENTS

| | | |
|---|---|---|
| DE | 20 2008 013 895 | 3/2009 |
| EP | 1 992 257 | 11/2008 |

(Continued)

*Primary Examiner* — Justin Larson
*Assistant Examiner* — Scott McNurlen
(74) *Attorney, Agent, or Firm* — Jacobson Holman, PLLC.

(57) ABSTRACT

A baby carrier adapted for carrying a child either face-to face or in forward-facing position includes chest straps, which are arranged to extend around both shoulder regions of the wearer, a waist belt connected to the chest straps, and a carrier bag mounted on the chest straps and the waist belt and including a front piece which together with at least the chest straps forms a carrier pouch, having leg openings. At least the lower portion of the front piece is connected to the waist belt and forms a first seat support, and the front piece is at an upper portion detachably connected to respective chest strap by a connecting device. A second wider seat support is at least partially detachably arranged between the waist belt and a region of the front piece at a level corresponding to the waist belt.

10 Claims, 2 Drawing Sheets

(56) References Cited

U.S. PATENT DOCUMENTS

| | | | | |
|---|---|---|---|---|
| 8,424,732 | B1 * | 4/2013 | Lehan et al. | 224/160 |
| 8,453,894 | B2 * | 6/2013 | Jung et al. | 224/160 |
| 8,636,181 | B2 * | 1/2014 | Gunter et al. | 224/160 |
| 2008/0283559 | A1 * | 11/2008 | Parness et al. | 224/159 |
| 2010/0308088 | A1 * | 12/2010 | Lindblom | 224/160 |
| 2011/0290831 | A1 * | 12/2011 | Wang | 224/160 |
| 2012/0199619 | A1 * | 8/2012 | Zack | 224/160 |

FOREIGN PATENT DOCUMENTS

| | | | | | |
|---|---|---|---|---|---|
| GB | 2026848 | A | * | 2/1980 | A45F 3/14 |
| JP | 09099842 | A | * | 4/1997 | B62B 9/10 |
| JP | 2003-10010 | | | 1/2003 | |
| JP | 2004358003 | A | * | 12/2004 | A47D 13/02 |
| JP | 2004358004 | A | * | 12/2004 | A47D 13/02 |
| JP | 2004358005 | A | * | 12/2004 | A47D 13/02 |
| JP | 2012187352 | A | * | 10/2012 | |

* cited by examiner

BABY CARRIER

CROSS-REFERENCE TO RELATED APPLICATIONS

This is a national stage of PCT/SE10/050,433 filed Apr. 21, 2010 and published in English, which claims the priority of Sweden number 0900554-7 filed Apr. 24, 2009, hereby incorporated by reference.

FIELD OF THE INVENTION

The present invention relates to a baby carrier adapted for carrying a child either face-to-face or in forward-facing position, comprising chest straps, which are arranged to extend around both shoulder regions of the wearer, a waist belt connected to the chest straps, and a carrier bag mounted on the chest straps and the waist belt comprising a front piece which together with at least the chest straps form a carrier pouch, having leg openings, whereby at least a lower portion of the front piece is connected to the waist belt and forms a first seat support, and the front piece is at an upper portion detachably connected to respective chest strap by a connecting device.

BACKGROUND OF THE INVENTION

Thus, the invention relates to a baby carrier of a kind which includes a harness of the general type comprising chest straps and a carrier poach mounted on the harness, which carrier pouch is formed of a front piece provided with leg openings or a part thereof and adapted to be carried on the chest side of a wearer.

When carrying a child on the chest side, particularly when the child no longer is an infant and the child starts to "discover" the world around himself, it is desirable to be able to carry the child on one hand face-to-face and on the other hand in forward-facing position, i.e. the child having its face directed from wearer.

When changing the seat position of the child in the baby carrier from face-to-face to the forward-facing position, for instance, a great change is however needed of the geometry of the baby carrier in the region of the pelvis of the child, since the effective width of the seat support of the baby carrier should be able to be changed between a relatively wide seat support, when the child is carried face-to-face, and a relative narrow seat support, when the child is carried in a forward-facing position. With a narrow seat support the child may easily move the legs, which is important so that the motor function is developed in an advantage way. This change of the width of the seat support should be able to be made in a fast and simple way with the baby carrier carried by the wearer, preferably even when the child is sitting in the baby carrier.

More preferably it is desirable that the seat position of the child in the baby carrier should be able to be changed in such a way that the child can be seating:

i) face-to-face with its legs placed around the waist of the wearer of the baby carrier, whereby a wide seat support is needed, ii) face-to-face with total free movement of the legs of the child, whereby a relatively narrow seat support is needed, and iii) in forward-facing position with total free movement of the legs of the child, whereby also in this case a relatively narrow seat support is needed. Thus, it is the position of the legs of the child which should be changed when changing the seat position of the child.

A further reason why the width of the seat support must be changed is that, when the child is sitting in forward-facing position, the seat support must not have such a width that it will force apart, part, the legs of the child, i.e. it is desirable to have a seat posture which is as ergonomically as possible for the child with correct position of the legs. If however the legs are forced apart of the seat support a pressure may arise on the inside of the legs of the child at the area of the thighs and against possible blood vessels in said area which may lead to reduced blood circulation in the legs. It is particularly important that the seat support is not too wide when carrying a heavier child.

U.S. Pat. No. 6,443,339 B1 describes a baby carrier used for holding a child in both face-to-face and in forward-facing position and provided with a width-reducing member for reducing the width of a lower portion of the backrest when the child is held in the forward-facing position. The width reducing member is described and shown to include a string adapted to cooperate with loops, a belt the length of which may be adjusted or D-rings adapted to cooperate with hooks so as to reduce the width of the lower portion. However, the width of the lower portion of the backrest cannot be adjusted to such an extent which is desirable.

SUMMARY OF THE INVENTION

The object of the invention is thus to achieve a baby carrier the seat support of which may be changed to a large extent for achieving a seat support which acts so as to achieve a favourable seat position for the child without the need for taking off or on the baby carrier and which may be change in a fast and simple way so as to obtain an optimal position of the legs of the child sitting in the baby carrier.

This object is achieved according to the invention by a baby carrier adapted for carrying a child either face-to-face or in forward-facing position, comprising chest straps, which are arrange to extend around both shoulder regions of the wearer, a waist belt connected to the chest straps, and a carrier bag mounted on the chest straps and the waist belt and comprising a front piece which together with at least the chest straps form a carrier pouch, having leg openings, whereby at least a lower portion of the front piece is connected to the waist belt and forms a first seat support, and the front piece is at an upper portion detachably connected to respective chest strap by a connecting device, wherein a second wider seat support is at least partially detachably arranged between the waist belt and a region of the front piece at a level corresponding to waist belt.

Further embodiments of the baby carrier according to the invention are described herein.

BRIEF DESCRIPTION OF THE DRAWINGS

The invention will now be described in more detail in the form of a non-limiting example with reference to the accompanying drawings, in which.

DETAILED DESCRIPTION OF PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
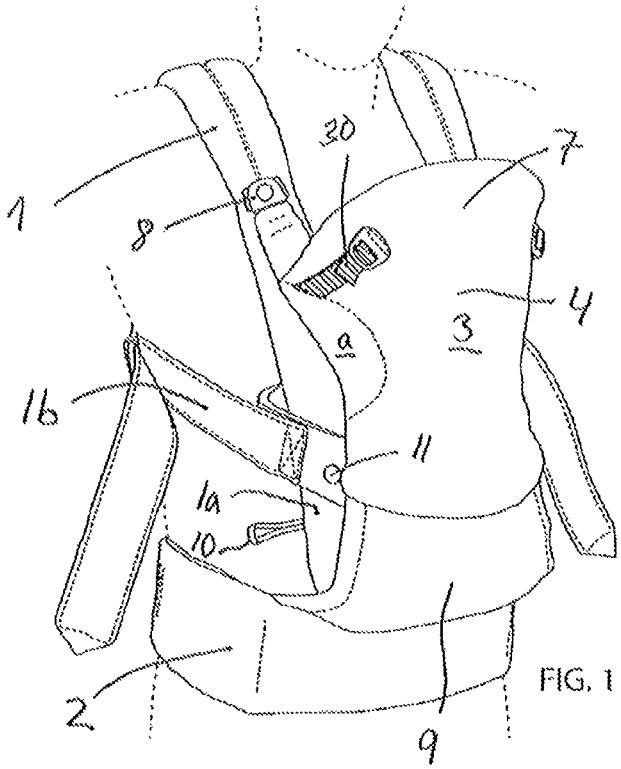
FIG. 1 illustrates a baby carrier according to the invention as carried on the chest of a schematically shown wearer with the baby carrier shown have wide seat support.
Figure 3:
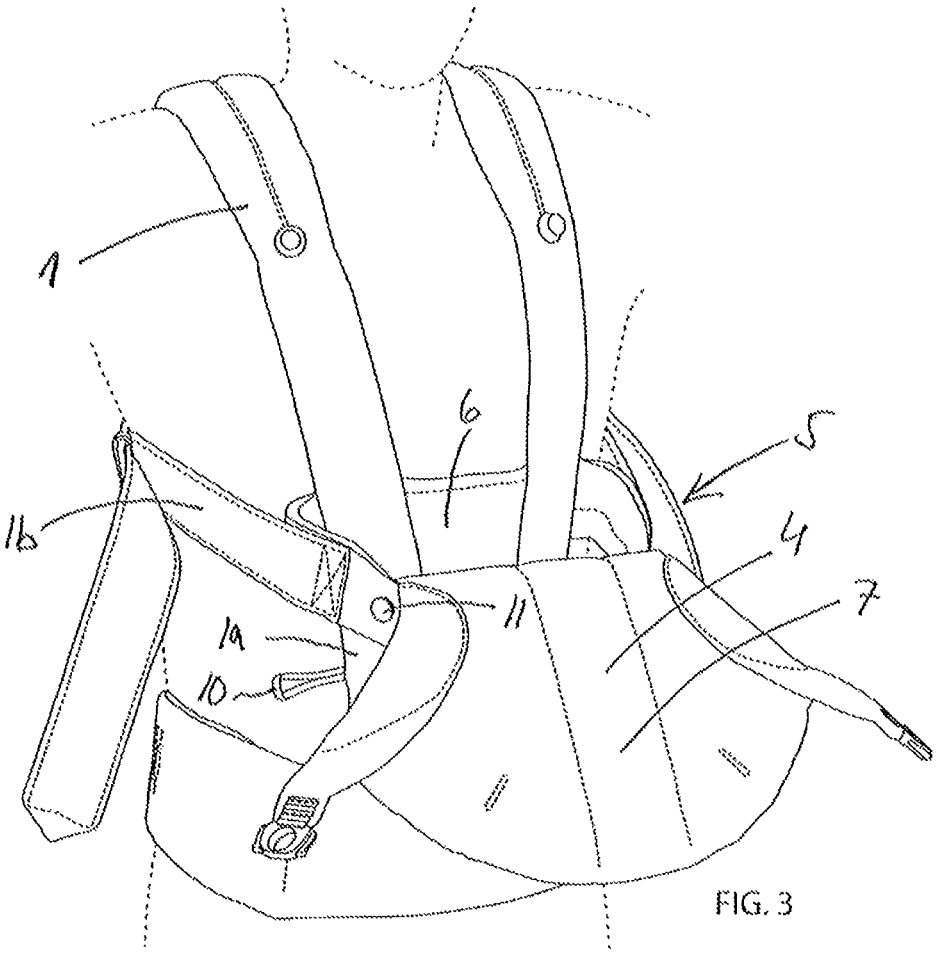
FIG. 3 illustrates the baby carrier according to the invention as carried on the chest of a schematically shown wearer with the upper portion of the front piece folded downwardly.

FIG. 1 shows a baby carrier according to the invention comprising adjustable chest straps 1, which are arranged to extend around the both shoulder regions of the wearer and which on the backside of the wearer are connected to each other by a fitting which is adjustable along the length of the chest straps, an adjustable waist belt 2, and a carrier bag 3 mounted on the chest straps and the waist belt, the carrier bag comprises a front piece 4 and, in a preferred embodiment, a carrier pouch 5 provided with leg openings (FIG. 3) which forms a lower portion of the front piece 4, and possibly a chest piece 6 (FIG. 3). The front piece 4 is at an upper edge region 7 detachably connected to respective chest strap 1 by a detachable connecting device 8, whereby the upper edge region 7 can be folded downwardly, preferably when the child is sitting in the baby carrier having forward-facing position or when the child is to be put into the baby carrier. A first end 1*a* of respective chest strap 1 is attached to the waist belt 2 while a second end 1*b* preferably is attached to an edge portion of the front piece 4 situated in the vertical direction, as seen when the carrier is worn, somewhat below the centre of the height of the front piece.

Regarding the expression that the chest straps 1 are arranged to extend around both should regions of the wearer it is to be understood that the chest straps either can be crossed or may stretch parallel to each other on the back side of the wearer, whereby in both cases the chest straps are connected to each other by a fitting which is movable along the length of the straps.

Furthermore, at least a lower portion of the front piece 4 is connected to the waist belt 2 and forms a second seat support 9 having relatively large width for carrying a child, not shown, by the baby carrier. This design of the seat support 9 is used when it is desirable to carry the child face-to-face and with the legs of the child positioned around the waist of the wearer of the baby carrier. This seat position of the child is preferably used for relatively small children, infants, and when it is desirable to observe how the baby feels or when the child is going to sleep. The upper edge region 7 of the front piece gives in this connection a good head support for the child. At respective laterally separated side edge of the upper edge region 7 an adjusting device 30 is arranged, which enables the effective distance to be set selectively of the upper edge region 7 so as to in the best possible way support the child's head when it is sleeping, for instance.

Figure 2:
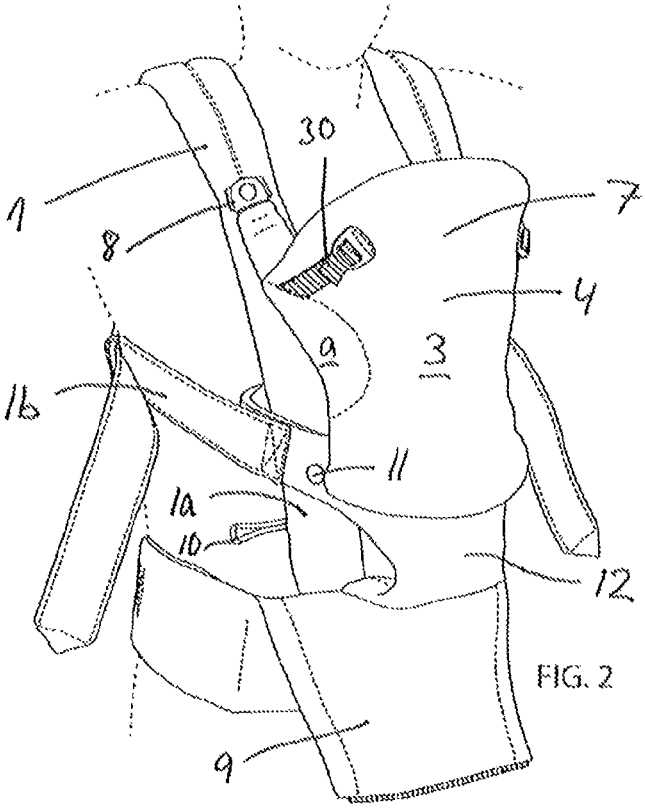
FIG. 2 illustrates the same view as in FIG. 1 with the baby carrier shown having narrow seat support.

In FIG. 2 the second wider seat support 9 is shown folded downwardly, whereby it can be seen that a first narrower seat support 12 is arranged and formed of a lower portion of the front piece 4 and connected to the waist belt 2, preferably at its upper edge. This narrower seat support 12 is used preferably when the child is carried face-to-face or in forward-facing position. In both cases the legs of the child have totally free movement thanks to the narrow seat support. Thus, the position of the legs of the child can be optimized. The width of the first seat support 12 can by this construction of the lower portion of the front piece 4 be shaped in a suitable way for adapting to the distance between the inside of the thighs of the child, so that none or a very low pressure exists against the inside of the thighs when the child is sitting in the baby carrier.

The upper edge of the second seat support 9 can, as shown in FIG. 2, be detachably attached to a lower portion of the front piece 4 by e.g. a zip-fastener, Velcro®-fastener, fastenings of plastic or metal, buttons, hooks and eyes or by any other detachable fastening device, and with the lower edge of the second seat support fixedly connected preferably with the upper edge of the waist belt 2. It is obvious for the man skilled in the art that the upper edge of the seat support can be fixedly connected to a lower portion of the front piece 4 and with the lower edge of the seat support 9 detachably connected to the waist belt 2 by said fastening devices, i.e. the seat support 9 may at least partly be detachably arranged between the waist belt 2 and the lower portion of the front piece 4 so that either the upper or the lower edge or both edges of the second seat support 9 can be detachable from the baby carrier.

As can be seen in FIGS. 1 and 2 a coupling device 10, 11 in the form of a loop 10, for instance, provided with one or several openings is adapted to be detachably connected to a button 11, which is provided at respective side of the baby carrier, preferably between a lower portion of a first end 1*a* and a second end 1*b* of the chest strap 1. When connecting the loop 10 with the button 11 the size of the leg opening formed between the side edge of the first or the second seat support and the first and the second end 1*a*, 1*b* of the chest strap 1 is reduced so as to prevent that a child unintentionally will slip out of the baby carrier.

In FIG. 3 the front piece 4 is shown detached by the connecting device 8 from the chest straps and folded downwardly along a line which is situated essentially at a level of the first and second end 1*a*, 1*b* of the chest strap 1. In this state of the baby carrier the child may easily be lifted into and out of the baby carrier.

The front piece 4 can at respective lateral side edge edges, preferably between the upper lateral corner of the upper edge region 7 and above the fastening of the second ends 1*b* of the chest strap 1 to the front piece, be provided with a portion of which is preferably softer than the rest of the front piece 4. The reason for this is that the front piece 4 shall not rub against the arms of the child. In a preferred embodiment the first ends 1*a* of the chest straps 1 are placed on the inside of the chest piece 6, i.e. directed towards the child.

In an embodiment not shown the second seat support 9 may be divided into two or several narrower seat supports so that they together form a wide seat support.

In yet another embodiment not shown the second seat support 9 may be fully detachable from the front piece 4 and the waist belt 2. By such an embodiment it is possible to change between supplementary seat supports 9 having different width depending upon the size of the child.

In still another embodiment not shown the second seat support 9 may be provided on the inside of the first seat support 12, whereby this second seat support 9 can be folded or rolled up against the stomach, for instance, or be totally detachable.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

What is claimed is:

1. A baby carrier adapted for carrying a child either face-to-face or in forward-facing position, comprising:

chest straps, which are arranged to extend around both shoulder regions of a wearer;

a waist belt connected to the chest straps; and a carrier bag mounted on the chest straps and the waist belt and including a front piece which together with at least the chest straps forms a carrier pouch, having leg openings, whereby at least a lower portion of the front piece is connected to the waist belt and forms a first seat support, and the front piece is at an upper portion detachably connected to each respective chest strap by a connecting device, with a second wider seat support being at least partially detachably arranged between an upper edge of the waist belt and a region of the front piece at a level corresponding to the waist belt, and with said first seat support being fixedly attached to said upper edge of the waist belt such that said waist belt is arranged below said first seat support.

2. The baby carrier according to claim 1, wherein the second wider seat support has essentially a same width over an entire length thereof.

3. The baby carrier according to claim 1, wherein the second wider seat support is arranged outwardly of the lower portion of the front piece forming the first seat support.

4. The baby carrier according to claim 1, wherein the second wider seat support is arranged inwardly of the lower portion of the front piece forming the first seat support.

5. The baby carrier according to claim 1, wherein the second wider seat support is detachably attached to either the lower portion of the front piece or the upper edge of the waist belt by at least one detachable fastening device.

6. The baby carrier according to claim 1, wherein the second wider seat support is detachably attached to both the lower portion of the front piece and the upper edge of the waist belt by at least one detachable fastening device.

7. The baby carrier according to claim 5, wherein said at least one fastening device is selected from the group consisting of a zip-fastener, Velcro®-fastener, fittings of plastic or metal, buttons, and hooks and eyes.

8. The baby carrier according to claim 1, wherein the second wider seat support includes at least two portions.

9. The baby carrier according to claim 6, wherein second wider seat supports having different widths are attachable to the baby carrier.

10. The baby carrier according to claim 1, wherein the chest straps on a backside of the wearer are connected to each other by fittings which are displaceable along the length of the chest straps.

* * * * *